US006453981B1

(12) United States Patent
Nomura et al.

(10) Patent No.: US 6,453,981 B1
(45) Date of Patent: Sep. 24, 2002

(54) COMPOSITE CORE FOR CASTING

(75) Inventors: Makoto Nomura, Nagoya; Katsuji Sugiura, Nishio, both of (JP)

(73) Assignee: TRW Automotive Japan Co., Ltd., Tokyo (JP)

( * ) Notice: Subject to any disclaimer, the term of this patent is extended or adjusted under 35 U.S.C. 154(b) by 0 days.

(21) Appl. No.: 09/440,611

(22) Filed: Nov. 15, 1999

(30) Foreign Application Priority Data

Nov. 16, 1998 (JP) ..... 10-325280

(51) Int. Cl.[7] ..... B22C 9/10
(52) U.S. Cl. ..... 164/369; 164/368
(58) Field of Search ..... 164/369, 368, 164/34, 35, 98, 76.1, 367

(56) References Cited

U.S. PATENT DOCUMENTS 5,318,094 A * 6/1994 Joy et al. ..... 164/98
5,566,742 A * 10/1996 Nemoto ..... 164/132
5,855,237 A * 1/1999 Okada et al. ..... 164/113
6,099,673 A * 8/2000 Van Bennekom ..... 156/187

* cited by examiner

*Primary Examiner*—M. Alexandra Elve
*Assistant Examiner*—Len Tran
(74) *Attorney, Agent, or Firm*—Tarolli, Sundheim, Covell, Tummino & Szabo L.L.P.

(57) ABSTRACT

A cast product is a housing for a power steering comprising a pair of large holes for both a contact valve and a cylinder, and a small hole connected to the large holes. In order to mold such a cast product, a composite core has large core portions for the large holes and small core portions for the small hole. The large core portions include resin films used to coat the outer periphery of metal bases exposed in a cavity. The small core portions include a resin body formed of a resin connected to the resin films on the outer periphery of the metal bases.

6 Claims, 6 Drawing Sheets

COMPOSITE CORE FOR CASTING

BACKGROUND OF INVENTION

1. Field of the Invention

The present invention relates to a composite core to be inserted and disposed in a cavity of a casting die.

2. Description of the Related Art

Conventionally, as shown in an unexamined Japanese Patent Publication No. 07-284902, a resin core formed with a resin is known. By locating a resin core having a shape according to holes and grooves for forming a desired cast product inside a cavity of a die and by pouring molten metal into the cavity of the die to mold a cast product, even a complicated resin core can be easily removed from the cast product, without remaining core refuse in the cast product after molding, unlike the molding with such a collapsible core as a sand core.

However, holes and grooves to be formed by casting are various and large ones and small ones may be intermingled. If such a conventional collapsible core as a sand core is used, the problem in strength arises and sand cannot be discharged through a small hole. Additionally, if a resin core is used, the resin core is deformed while molten metal is poured, because of the difference of thermal capacity between a large resin core portion and a small resin core portion. This hinders the forming of high-precision casting.

SUMMARY OF THE INVENTION

An object of the invention is to provide a composite core having a resin for casting a cast product wherein a large hole and a small hole are intermingled.

According to an aspect of the present invention, a composite core for die casting comprises a large core portion for a large hole of a cast product (a casting) and a small core portion for a small hole communicating to the large hole of the cast product The large core portion includes a core base and a resin film used to coat the outer periphery of the core base, and the small core portion has a resin body formed of a resin connected to the resin film. The core base may be formed so as to be hollow.

According to another aspect of the present invention, a composite core for die casting comprises a pair of large core portions crossing each other for a pair of large holes of a cast product and a small core portion for a small hole communicating to the pair of large holes of the cast product respectively. Moreover, the pair of large core portions may include a pair of core bases and a resin film used to coat the outer periphery of the pair of core bases, and the small core portion may include a resin body formed of a resin connected to the resin film.

According to a further aspect of the present invention, a composite core used for casting a housing for a power steering on vehicle comprises a pair of large core portions crossing each other for a pair of large holes crossing each other in the housing for a contact valve and a cylinder and a small core portion for a communicating hole connected to the large holes for the contact valve and the cylinder respectively in the housing.

As aforementioned, in the composite core of the present invention, the dispersion of thermal capacity of each part is small to prevent small core portions from being deformed. Furthermore, since the core base coated with a resin is used for a large core portion, the necessary quantity of the resin is smaller than when the core is formed with only the resin. As a result, the composite core is easily formed by injection molding in a shorter time.

BRIEF DESCRIPTION OF DRAWINGS

The invention will now be described, by way of example, with reference to the drawings, in which.

DETAILED DESCRIPTION OF THE PREFERRED EMBODIMENTS

Figure 7:
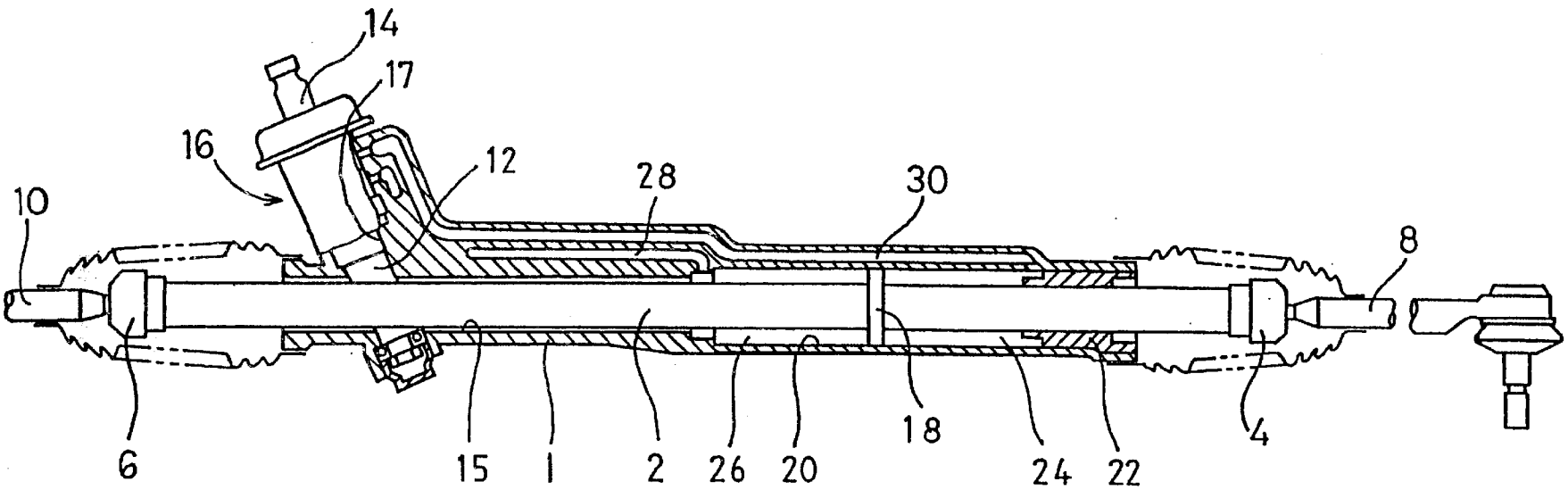
FIG. 7 is a sectional view of a power steering using a housing molded by the composite core according to the embodiment.

As shown in FIG. 7, a rack bar 2 is held so as to be slidable axially in a housing 1 of a power steering. Tie rods 8 and 10 are connected, via adjustable joints 4 and 6, to both ends of the rack bar 2.

In the housing 1, also, a pinion shaft 12 having a pinion meshed with racks formed on the rack bar 2 is rotatably held so as to cross the rack bar 2. An input shaft 14 rotationally driven by the operation of an unshown steering wheel is disposed in the coaxial direction of the pinion shaft 12. A control valve 16 which changes the supply direction of hydraulic fluid provided from an unshown hydraulic fluid source is arranged in the housing 1. An insertion hole 17 to receive the control valve 16 is arranged in the housing 1.

The housing 1 has a through-hole 15 to receive the rack bar 2 and a slide hole 20 into which a piston 18 integrally mounted to the rack bar 2 is slidably inserted. Both holes are formed co-axially. A plug member 22 is fitted in at one end of the slide hole 20. The rack bar 2 extends outwardly through the plug member 22. Operation chambers 24 and 26 enclosed by the housing 1 and the plug member 22 are formed on both sides of the piston 18. The control valve 16 communicates with both operation chambers 24 and 26 through communicating holes 28 and 30, respectively.

Once an unshown steering is operated, the input shaft 14 is rotated and the control valve 16 is changed over. As a result, supply and discharge of hydraulic fluid into and from the both operation chambers 24 and 26 are performed through the communicating holes 28 and 30. Consequently, because of the action on the piston 18 caused by the introduced pressured hydraulic fluid, a driving force in accordance with the direction of the steering operation is exerted on the rack bar 2.

The aforementioned housing 1 is molded by die casting of aluminum alloy. A composite core for molding the housing 1 as a cast product is explained with reference to FIG. 1 to 5. A composite core 31 is shaped to form an insertion hole 17, a through-hole 15, a slide hole 20 and communicating holes 28 and 30 in the housing 1. The insertion hole 17 and the through-hole 15 and the slide hole 20 have a large diameter. The communicating holes 28 and 30 have a small diameter.

In the composite core 31, a first large core portion 32 is formed for the insertion hole 17, and also a second large core portion 34 is formed for the through-hole 15 and the slide hole 20. A first small core portion 36 is also formed for the communicating hole 28 and a second small core portion 37 for the communicating hole 30.

Figure 1:
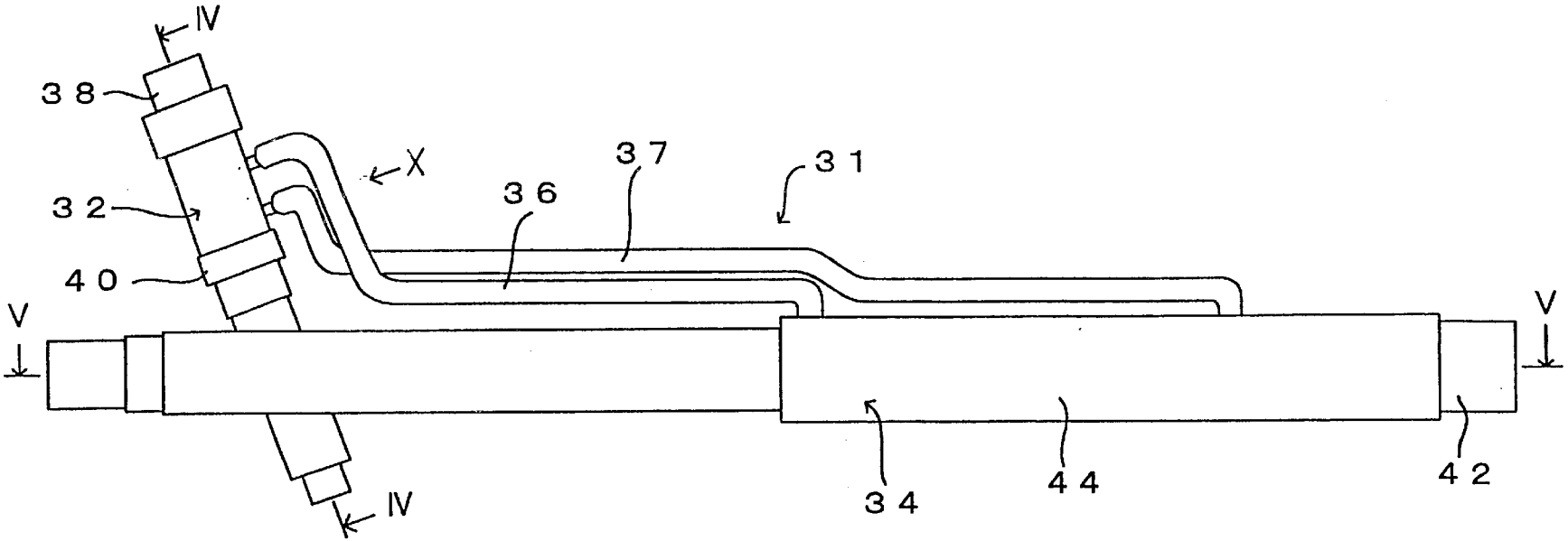
FIG. 1 is a front view of a composite core according to a first embodiment of the present invention.
Figure 2:
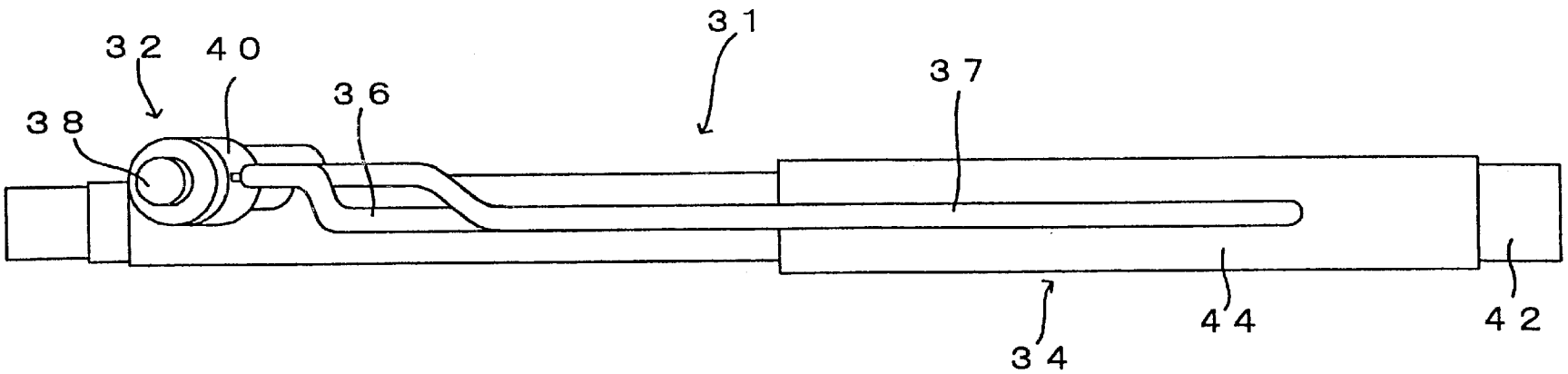
FIG. 2 is a top view of the embodiment.
Figure 3:
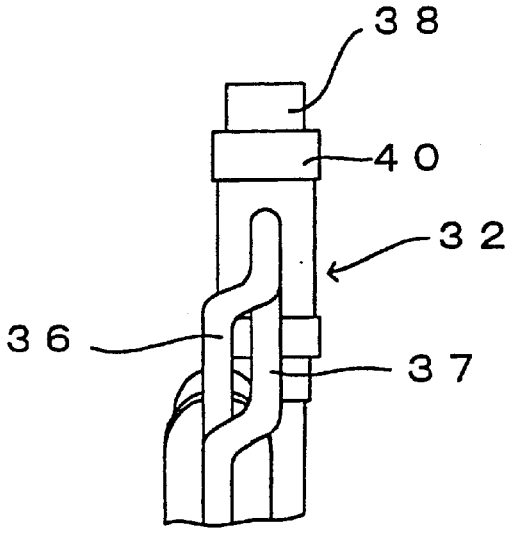
FIG. 3 is a view in the direction of the arrow X of FIG. 1.
Figure 4:
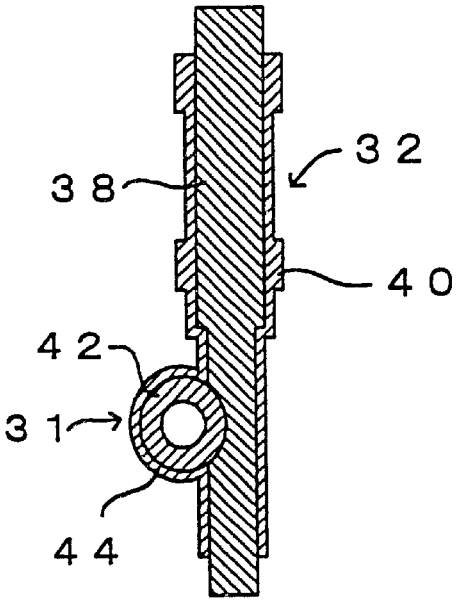
FIG. 4 is a sectional view taken along the lines IV—IV of FIG. 1.

As shown in FIG. 4, the first large core portion 32 is formed with the outer periphery of a metal base 38 coated by a resin film 40. When the composite core 31 is inserted into a die 50, the metal base 38 in a cavity 52 is coated with the resin film 40 so that the metal base 38 would not be exposed in the cavity 52.

Furthermore, according to a profile of the insertion hole 17 to be formed, a corresponding profile is formed by the resin film 40 The metal base 88 is formed longer than the insertion hole 17 in length so that a wall of the die 50 can hold the metal base 38 when the composite core 31 is inserted into the die 50.

In order to form the resin film 40, polycarbonate, polypropylene, polyethylene or copolymer of them and the like are used. The resin film 40 is preferably high in glass-transition temperature, impact resistance and ductility. The preferable thickness of the resin film 40 ranges from 3 to 5 mm, because it takes longer to form the composite core 31 by injection molding if the resin film 40 is thicker. To the surface of the resin film 40, such a heat-resisting resin as silicone resin or the like may be applied.

Figure 5:
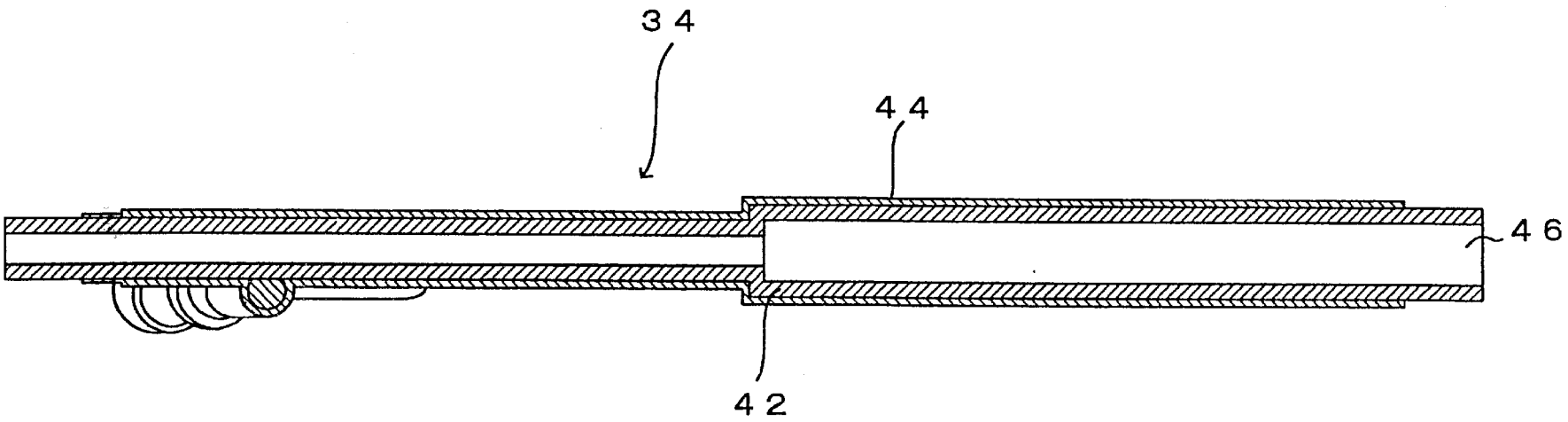
FIG. 5 is a sectional view taken on line V—V of FIG. 1.

The second large core portion 34 is formed wherein a metal base 42 crossing the metal base 38 of the first large core portion 32 is coated with a resin film 44. The metal base 42 is hollow inside with a through-hole 46 formed axially as shown in FIG. 5. When the composite core 31 is inserted into the die 50, the metal base 42 in the cavity 52 is coated with the resin film 44 so that the metal base 42 would not be exposed in the cavity 52.

The metal base-42 is formed longer than the through-hole 15 and the slide hole 20 of the housing 1 in length so that a wall of the die 50 can hold the metal base 42 when the composite core 31 is inserted into the die 50. The material of the resin film 44 is same as that of the resin film 40 used for the first large core portion 32. On the other hand, the first small core portion 36 and the second small core portion 37 are formed by using the same resin as the aforementioned resin for the first and second large core portions 32, 34 without a metal base. The first and second small core portions 36, 37 are a resin body, formed of only resin. The thickness of resin film for the large core portion and the diameter of resin body for the small core portion are set in such a manner to uniform the thermal shock from molten metal. For example, both portions may be uniformed in thickness, and even in volume, so that the thermal capacity of resin film could be same as that of resin body.

The composite core 31 is formed by injection molding wherein the metal bases 38 and 42 are inserted into an unshown die to mold the first large core portion 32, the second large core portion 34, the first small core portion 36 and the second small core portion 37 integrally. As a result, the resin bodies of the first and second small core portions 36, 37 are integrated with the resin film 40 for the first large core portion 32 and the resin film 44 for the second large core portion 34.

By injection molding the first large core portion 32 and the second large core portion 34, and separately by forming the first small core portion 36 and the second small core portion 37, the first small core portion 36 and the second small core portion 37 may be inserted and attached to the first large core portion 32 and the second large core portion 34.

Figure 6:
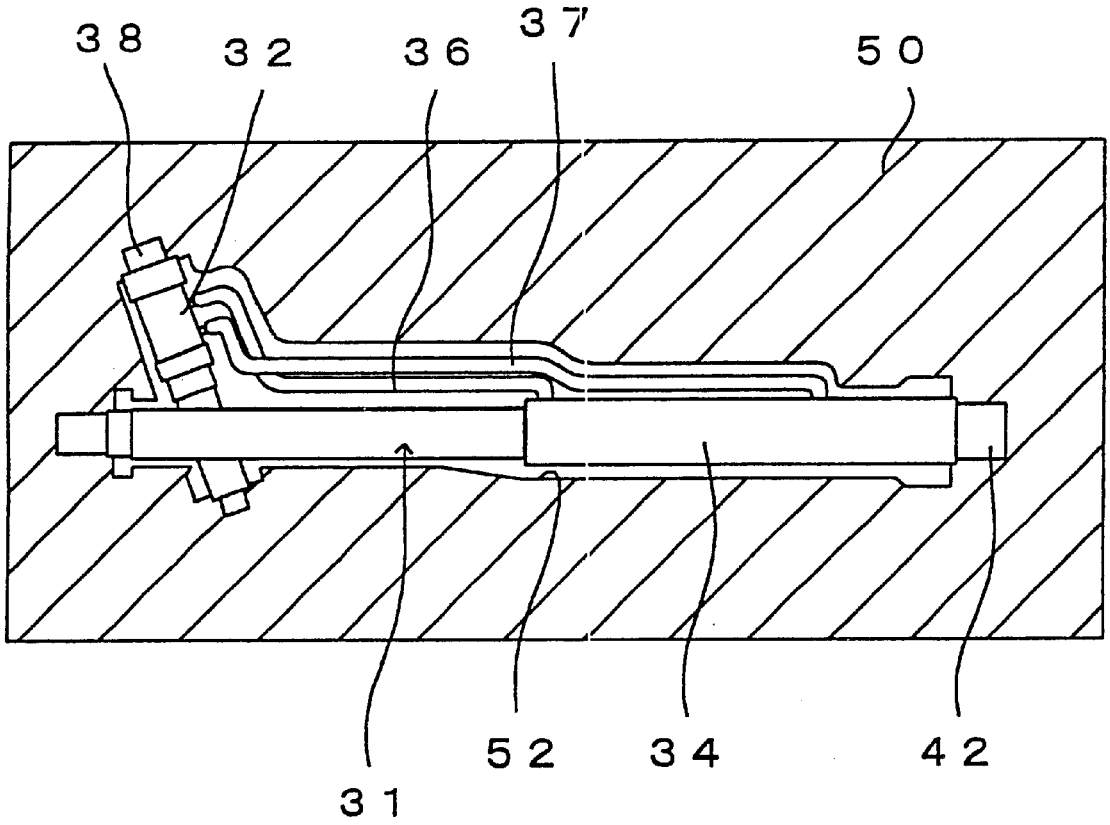
FIG. 6 is a sectional view wherein the composite core according to the embodiment is inserted into a die.

As shown in FIG. 6, the composite core 31 formed by the aforementioned method is inserted into the cavity 52 of the die 50 formed in accordance with the external shape of the housing 1. At that time, the composite core 31 is supported and positioned inside the cavity 52 by the metal bases 38 and 42 and the wall of die 50. Then molten aluminum alloy is poured into the cavity 52.

The temperature of the composite core 31 rises because of the heat of the molten aluminum alloy. Since the resin films 40 and 44 for the first large core portion 32 and the second large core portion 34 and the resin bodies for the first small core portion 36 and the second small core portion 37 have poor thermal conductivity, however, the inner temperature does not rise much, even if the surface temperature touched to the aluminum alloy reaches almost the alloy temperature. Accordingly, the resin films 40 and 44 for the first large core portion 32 and the second large core portion 34 and the resin bodies for the first small core portion 36 and the second small core portion 37 are hardly plasticized to maintain the strength.

In the resin films 40 and 44 for the first large core portion 32 and the second large core portion 34 and the resin bodies for the first small core portion 36 and the second small core portion 37, the dispersion of thermal capacity of each part is small because of almost equal volume of each part, to prevent the first small core portion 36 and the second small core portion 37 from being deformed.

Furthermore, since the metal bases 38 and 42 coated with the resin films 40 and 44 are used for the insertion hole 17, the through-hole 15 and the slide hole 20 as a large hole in the composite core 31, the necessary quantity of the resin is smaller than when the core is formed of only resin. Therefore, the composite core 31 is easily formed by injection molding in a shorter time.

The invention is not restricted to the above described embodiments and may be embodied in various forms without departing from the spirit and the scope of the invention.

What is claimed is:

1. A composite core for die casting, comprising:

a large core portion for a large hole of a cast product; and a small core portion for a small hole communicating to said large hole of said cast product, wherein said large core portion includes a metal core base and a resin film used to coat the outer periphery of said metal core base and said small core portion has a resin body formed of a resin connected to said resin film.

2. The composite core according to claim 1 wherein the metal core base is hollow.

3. A composite core for die casting, comprising:

a pair of large core portions crossing each other for a pair of large holes of a cast product; and a small core portion for a small hole communicating to said pair of large holes of said cast product respectively, wherein said pair of large core portions include a pair of metal core bases and a resin film used to coat the outer periphery of said pair of metal core bases, said small core portion includes a resin body formed of a resin connected to said resin film.

4. The composite core according to claim 3 wherein the metal core-base is hollow.

5. The composite core used for casting a housing for a power steering on vehicle, comprising:

a pair of large core portions crossing each other for a pair of large holes crossing each other in said housing for a contact valve and a cylinder; and a small core portion for a communicating hole connected to said large holes for the contact valve and the cylinder respectively in said housing, wherein said pair of large core portions include a pair of metal core bases crossing each other and a resin film used to coat the outer periphery of said pair of metal core bases, said small core portion include a resin body formed of a resin connected to said resin film.

6. The composite core according to claim 5 wherein the metal core base is hollow.

* * * * *